US005897149A

United States Patent [19]

Frolov

[11] Patent Number: 5,897,149

[45] Date of Patent: Apr. 27, 1999

[54] ARMATURE ASSEMBLY FOR MULTIPLE LOCKS

[75] Inventor: George Frolov, Farmington, Conn.

[73] Assignee: Harrow Products, Inc., Grand Rapids, Mich.

[21] Appl. No.: 08/838,864

[22] Filed: Apr. 11, 1997

Related U.S. Application Data

[60] Provisional application No. 60/015,784, Apr. 17, 1996.

[51] Int. Cl.[6] ..... E05C 17/56

[52] U.S. Cl. ..... 292/251.5; 292/144

[58] Field of Search ..... 292/251.5, 144, 292/DIG. 55, DIG. 60, 201, DIG. 25

[56] References Cited

U.S. PATENT DOCUMENTS

| | | | |
|---|---|---|---|
| 4,652,028 | 3/1987 | Logan | 292/251.5 |
| 4,915,431 | 4/1990 | Bailey | 292/251.5 |
| 4,981,312 | 1/1991 | Frolov | 292/251.5 |
| 4,986,581 | 1/1991 | Geringer | 292/251.5 |
| 5,016,929 | 5/1991 | Frolov | 292/251.5 |
| 5,065,136 | 11/1991 | Frolov | 292/251.5 |
| 5,139,293 | 8/1992 | Zimmerman | 292/251.5 |
| 5,141,271 | 8/1992 | Geringer | 292/251.5 |
| 5,184,855 | 2/1993 | Waltz | 292/251.5 |
| 5,184,856 | 2/1993 | Waltz | 292/251.5 |
| 5,611,582 | 3/1997 | Frolov | 292/251.5 |

*Primary Examiner*—Steven Meyers
*Assistant Examiner*—Gary Estremsky
*Attorney, Agent, or Firm*—Alix, Yale & Ristas, LLP

[57] ABSTRACT

A multiple electromagnetic barrier lock system employs a plurality of electromagnetic lock assemblies for locking the barrier to the barrier frame. An armature assembly electromagnetically bonds to the electromagnet when the barrier is closed. Each armature/electromagnet assembly has an armature plate with an attractive face oriented toward the electromagnet and an oppositely positioned rear face oriented toward the barrier face. A mounting assembly is configured to mount the armature plate to the barrier face so that the armature plate is positionable in a first position closer to the barrier face and a second position away from the barrier face. A spring biases the armature plate to the first position.

13 Claims, 6 Drawing Sheets

ARMATURE ASSEMBLY FOR MULTIPLE LOCKS

CROSS REFERENCE TO RELATED APPLICATION

This application claims priority based on Provisional Application No. 60/015,784 filed on Apr. 17, 1996.

BACKGROUND OF THE INVENTION

This invention relates to the field of electromagnetic door security systems. More specifically, this invention relates to an armature adapted for attractive engagement to an electromagnet of a multiple electromagnetic lock door security system.

Electromagnetic door security systems are well-known for controlling access to secured areas. These door security systems have proven to be safe and reliable in securing a door and also allowing fail safe egress in an emergency situation. Electromagnetic door security systems typically employ a single electromagnet fixed to the door frame and a single armature mounted to the door for attractive engagement to the electromagnet. The attractive engagement generates a substantial magnetic locking force to resist opening of the door.

Electromagnetic door security systems have proven to be generally resistant to forced entry. In particular, these systems are resistant to large static forces applied to the door. However, in some operational environments and under certain extreme conditions, the bonding engagement of the single armature and the single electromagnet may be susceptible to unauthorized destruction. More specifically, it has been found in some public environments having secured gates and fire doors, unauthorized personnel can generate momentary high dynamic peak forces against the secured gates and doors. These high peak forces may be sufficient to overcome the attractive engagement of the single electromagnet and armature, and therefore defeat the door security system. Such momentary peak forces are typically generated by forceful kicks or other methods of battering against the door or gate.

These brief, but high intensity, peak forces or spikes can momentarily overcome the attractive engagement of the single armature to the single electromagnet and therefore allow the door to swing open. The problem can be particularly exacerbated by the solid doors and heavy gates typically employed in public facilities. These solid doors and gates are rigid and thus exhibit little flexion, and consequently, a substantial portion of the peak force from a kick or battering is efficiently transmitted to the door security system. In addition, the door structure may warp or deform as a result of the exerted force.

To overcome the potential deficiencies in conventional electromagnetic lock security systems, multiple electromagnetic locks have been employed to increase the locking force on a particular door.

These multiple electromagnetic lock systems theoretically provide at least twice the locking force of the single electromagnetic lock in a conventional door security system. However, multiple electromagnetic lock systems can exhibit several operational deficiencies. Typically, multiple electromagnetic lock systems employ a pair of electromagnetic locks. Each electromagnetic lock has an electromagnet and an associated armature assembly. In order to obtain maximum benefit of a multiple electromagnetic lock system, additional careful attention must be directed to providing proper alignment of the electromagnets and armatures during the initial installation procedure. Slight variations in positioning during the installation of the multiple electromagnetic locks can result in only one of the electromagnetic locks fully engaging in surface-to-surface contact when the door is in the locked state. A gap may exist between the second electromagnet and associated armature assembly even when the door is in the locked state. A significant gap between the second electromagnet and associated armature assembly may substantially decrease the bonding force of that second electromagnetic lock and therefore of the entire multiple electromagnetic lock door security system.

Warped, twisted or otherwise damaged doors can also result in only one of the electromagnetic locks fully engaging, thereby decreasing the overall bonding force of the multiple electromagnetic lock door security system. Furthermore, due to the rough use that many of these doors and gates can experience during their operational lifetime, a door can later exhibit warping, twisting and other damage that prevents full engagement of both pairs of electromagnets and armatures—even if the electromagnetic locks are initially installed correctly. Therefore, the electromagnets and armatures may require continual realignment in order to obtain the maximum bonding force of the multiple electromagnetic lock system. This requirement for continuing maintenance increases the operating costs of such door security systems.

While the invention is described as employed with a door in the following description, it should be readily understood the invention is compatible with all forms of barriers selectively positionable across openings to prevent access. This particularly includes gates and other barriers typically employed at public facilities such as subways and trains.

SUMMARY OF THE INVENTION

Briefly stated, the invention in a preferred form is a self-adjusting armature for attractive engagement to an electromagnet of a multiple electromagnetic lock system. The armature assembly includes an armature plate mounted to the vertical face of the door. The armature plate defines an attractive face for engagement to the electromagnet and a rear face opposite the attractive face. A bore extends through the armature plate to define an opening between the attractive face and the rear face. A support ring defining a reduced opening is mounted to the rear face of the armature plate. The support ring defines an annular impact shoulder generally coaxial with the bore.

A mounting assembly having an expanded head portion engageable to the shoulder of the support ring is positioned within the bore. Extending from the head portion of the mounting assembly is a reduced shank portion. The shank portion passes through the rear face of the armature plate and the opening of the support ring, and is anchored to the door.

The armature plate is movable on the mounting assembly between a first position wherein the expanded head portion of the mounting assembly and the shoulder of the support ring define an initial gap, and a second position wherein the expanded head portion and the shoulder engage. A spring supported by the mounting assembly biases the armature plate toward the first position to maintain the initial gap.

A multiple electromagnetic lock system of the invention preferably employs two electromagnetic locks. The electromagnets of the electromagnetic locks are mounted adjacent each other to the upper edge of a door frame. The electromagnets define generally co-planar bonding faces. Mounted on the vertical or horizontal face of the door opposite each electromagnet is a self-adjusting armature assembly for bonding engagement therewith. In operation, the door is secured by the magnetic bonding of each armature assembly to each respective electromagnet. In the powered down or unlocked mode, the armature assemblies are positioned so the attractive face of the armature plate and the bonding face of the electromagnet are in oppositely adjacent relationship when the door is closed. The electromagnetic locks are preferably arranged so the first electromagnetic lock engages in surface-to-surface contact between the electromagnet and the armature assembly when the door is in the fully closed position. The electromagnet and armature assembly of the second electromagnetic lock are arranged to define an armature gap therebetween. In the powered down or unlocked state, the spring maintains the initial gap between the expanded head portion of the mounting assembly and the shoulder ring of the armature plate.

Energizing or locking the door security system energizes both electromagnets and causes the armature plate to be attracted to the electromagnet of the second electromagnetic lock. The attractive force overcomes the biasing force of the spring, and the armature plate moves to an intermediate position between the first position and the second position, adjusting for the armature gap. Therefore, the armature plate of the first electromagnetic lock will be in the initial position and the armature plate of the second electromagnetic lock will be in an intermediate position. The movement of the armature plate of the second electromagnetic lock to an intermediate position results in full engagement of each armature to its associated electromagnet.

In use, when a forced entry is attempted, the expanded head portions of the mounting assemblies will engage the respective shoulder rings of each electromagnetic lock. The expanded head portions of the mounting assemblies and shoulder rings of each electromagnet and armature assembly pair may not simultaneously engage due to possible misalignment of the armature assemblies, electromagnets and door. Unauthorized personnel attempting a forced entry could overcome the bonding force of one of the electromagnetic locks in the engaged position. However, should that electromagnetic lock disengage, the subsequent motion of the door will then bring the mounting assembly and shoulder ring of the other lock into engagement, thereby continuing securement of the door and preventing unauthorized entry. The biasing force of the spring of the electromagnetic lock that remains engaged will return the door to a position wherein the armature plate and electromagnet of the disengaged electromagnetic lock can re-engage, therefore re-exerting the maximum bonding force against forced entry.

An object of the invention is to provide an armature for an electromagnetic lock that self-adjusts for transverse misalignment of the electromagnet and armature assembly.

Another object of the invention is to provide a multiple electromagnetic lock system that is highly resistant to kicks and other battering forces.

A still another object of the invention is to provide a cost effective armature that does not require continual adjustments.

A yet another object of the invention is to provide a self-adjusting armature having a low profile.

These and other objects of the invention will become apparent from the following description and the drawings.

DETAILED DESCRIPTION OF THE PREFERRED EMBODIMENT

Figure 1:
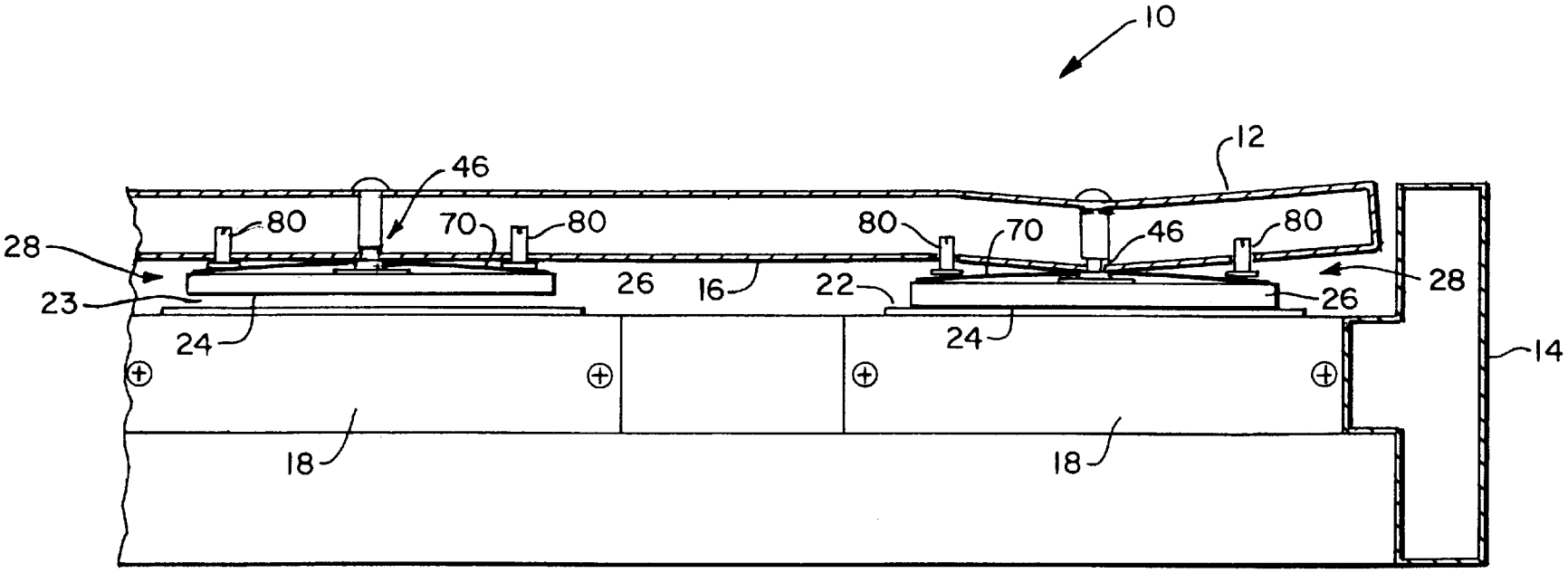
FIG. 1 is a fragmentary sectional view of a multiple electromagnetic lock system installed in conjunction with a door and associated door frame wherein the door has an exaggerated warp, the multiple electromagnetic lock system has electromagnetic locks employing the self-adjusting armature of the invention, and the electromagnetic locks are in an un-energized or an unlocked state.

With reference to the drawings wherein like numerals represent like components throughout the figures, a multiple electromagnetic lock system which incorporates the self-adjusting armature in accordance with the invention is generally designated by the numeral 10. The system 10 secures a door or a gate 12 supported by a door frame 14. The invention will be described in terms of a door 12, but the invention also has applicability in conjunction with a gate (not illustrated) or other types of barriers, including a door or gate, which swings and which selectively secures an area.

The door 12 has a door vertical face 16 that is generally perpendicular (subject to warp, deformation or other damage) to the floor throughout the swing or pivotal travel of the door. The door 1 2 functions as a selectively positionable door or a gate for forming a barrier across the entranceway defined by the door frame 14. The door security system 10 preferably has a pair of electromagnetic locks 28. Each electromagnetic lock 28 has an electromagnet 18 and oppositely positioned self-adjusting armature assembly 20 for securing the door 12. The electromagnets 18 are mounted in adjacent fixed positions relative to the door frame 14. The electromagnets 18 are preferably installed to define co-planar bonding faces 22 oriented toward the door vertical face 16.

The armature assemblies 20 are anchored on the door vertical face 16 in opposite relation to the electromagnets 18. Each armature assembly 20 defines an attractive face 24 positioned opposite the respective bonding face 22 of the electromagnets 18. Typically, the armature assemblies 20 attractively engage to the electromagnets 18 to prevent the door 12 from swinging outward.

In an alternative installation (not shown), the bonding faces 22 of the electromagnets 18 are oriented away from the door 12, and the armature assemblies 20 are anchored to an armature bracket affixed to the door 12. The armature assemblies 20 are arranged in a position generally parallel with the door vertical face 16 and attractively engaged to the electromagnets 18 to prevent the door 12 from swinging inward.

Figure 3:
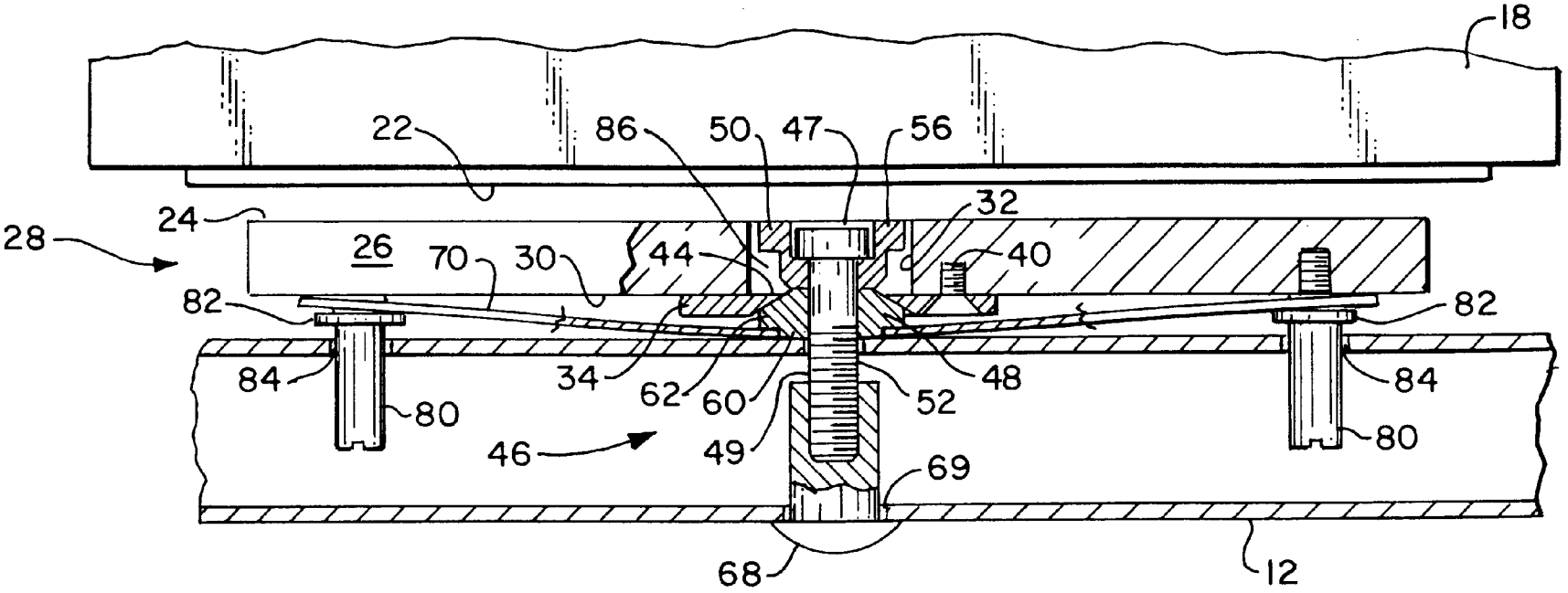
FIG. 3 is a fragmentary sectional view, partially broken away, of the door and one electromagnetic lock employing the self-adjusting armature assembly of the multiple electromagnetic lock system of FIG. 1 wherein the electromagnetic lock is in the unlocked state.
Figure 4:
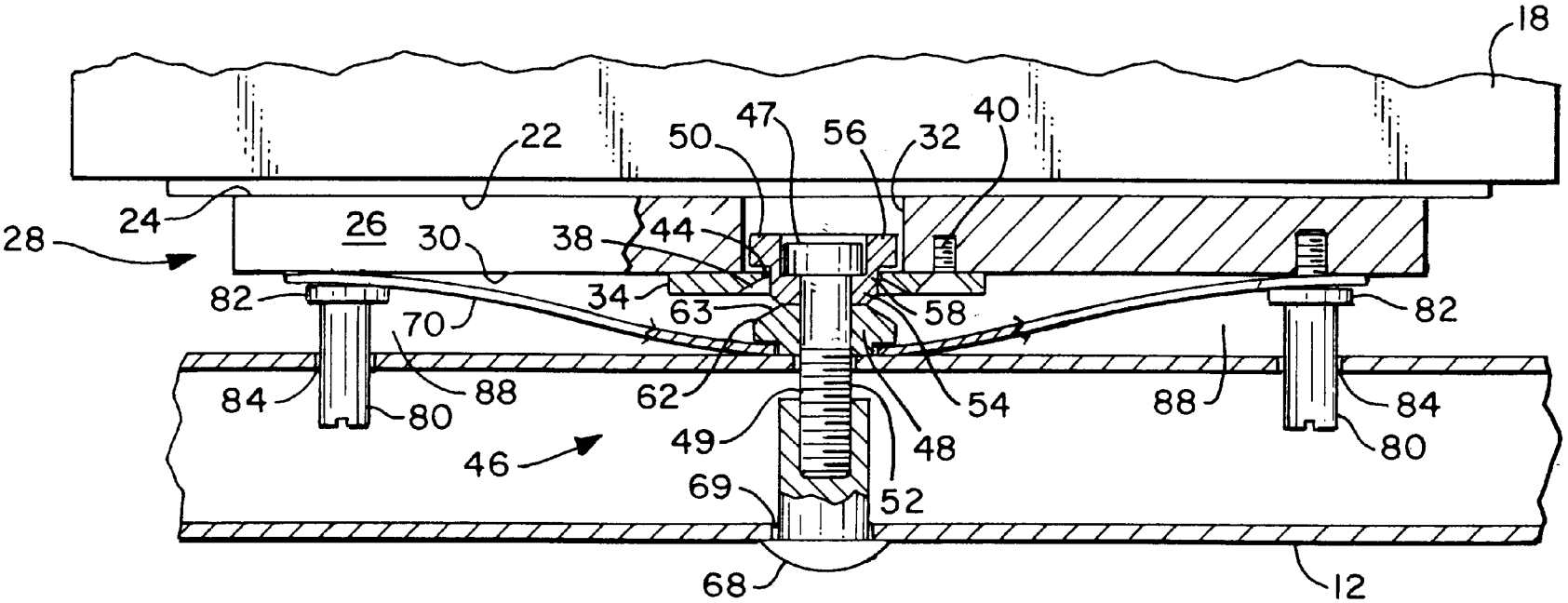
FIG. 4 is a fragmentary sectional view, partially broken away, of the door and electromagnetic lock of FIG. 3 wherein the electromagnetic lock is in the locked state and a force is applied to the door.
Figure 5:
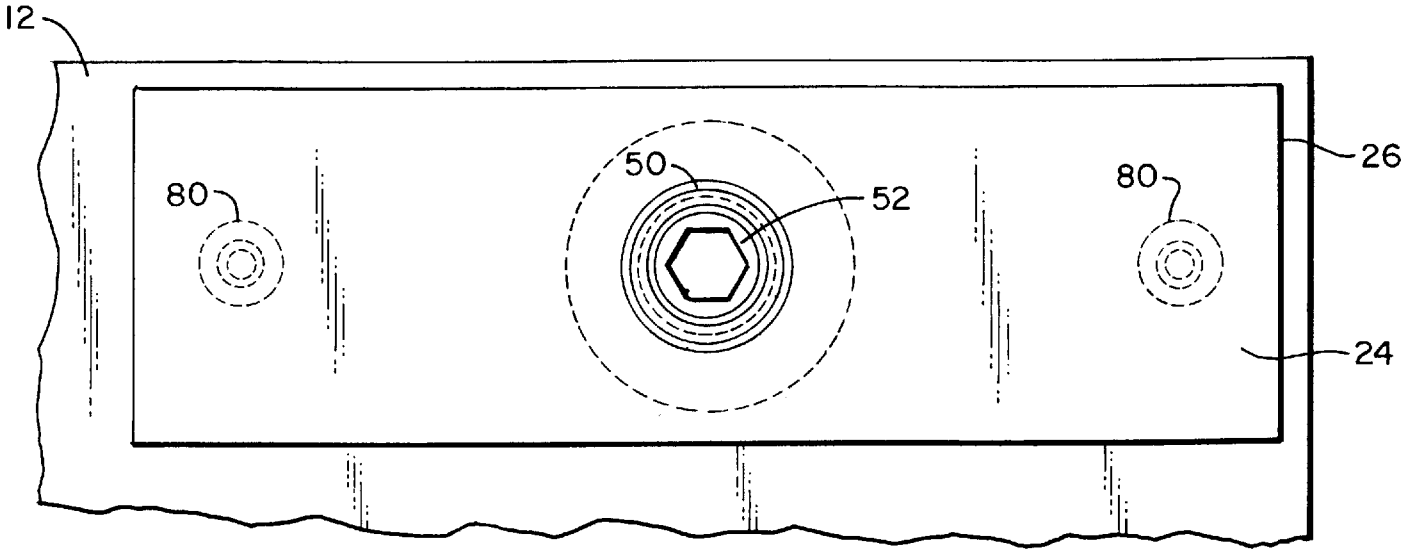
FIG. 5 is a frontal view, partially in phantom, of the door and a single self-adjusting armature assembly of the multiple electromagnetic lock system of FIG. 1.

Each armature assembly 20 has an elongated armature plate 26 for electromagnetic bonding to the oppositely positioned electromagnet 18. The armature plate 26 has a rear face 30 oppositely disposed from the attractive face 24. The armature plate 26 defines a central straight bore 32 (FIGS. 3 and 4) generally perpendicular to the attractive face 24 and preferably circular for simplified manufacture. The bore 32 forms a continuous opening through the armature plate 26 from theattractive face 24 to the rear face 30.

An annular planar support ring 34 is mounted to the rear face 30 of the armature plate 26. The support ring 34 is coaxially positioned over the bore 32. The support ring 34 defines a reduced opening 36 having a diameter less than the diameter of the bore 32. The inner edge of the support ring 34 around the opening 36 defines an annular bevel 38 oriented away from the rear face 30. The inner edge of the support ring 34 opposite the bevel 38 defines an annular shoulder 44 generally co-planar with the rear face 30. The support ring 34 is supported on the rear face 30 of the armature plate 26 by three countersunk fasteners 40 extending through support openings 42 in the support ring 34 and rotatably threadably engaging the armature plate 26.

Figure 7:
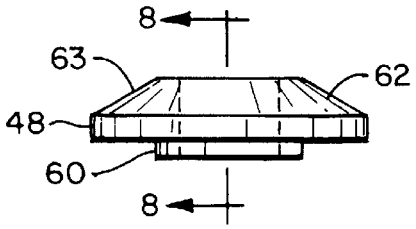
FIG. 7 is an enlarged side view, partially in phantom, of a first mounting collar of the self-adjusting armature assembly of FIG. 1.
Figure 8:
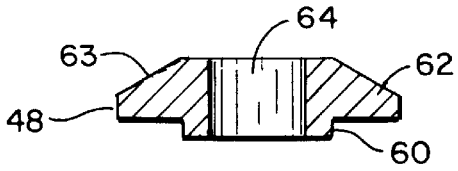
FIG. 8 is a cross-sectional view of the first mounting collar of FIG. 7 taken along the line 8—8 thereof.
Figure 9:
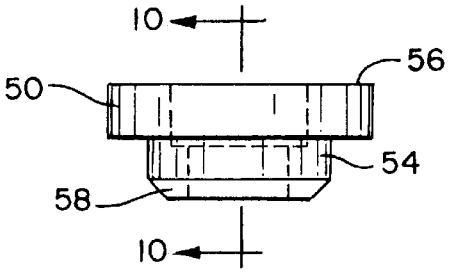
FIG. 9 is an enlarged side view, partially in phantom, of a second mounting collar of the self-adjusting armature assembly of FIG. 1.
Figure 10:
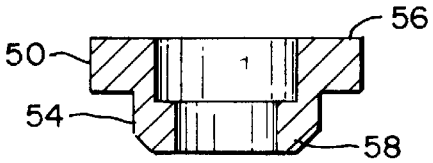
FIG. 10 is a cross-sectional view of the second mounting collar of FIG. 9 taken along the line 10—10 thereof.
Figure 11:
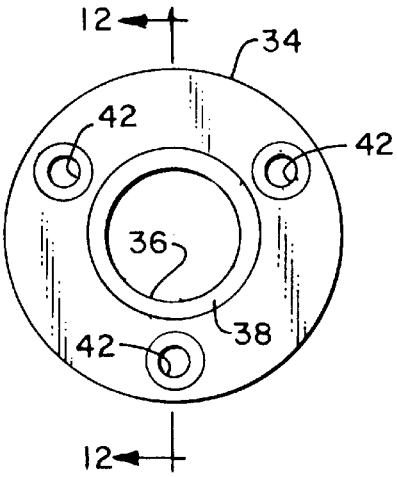
FIG. 11 is an enlarged top view of a shoulder ring of the self-adjusting armature assembly of FIG. 1.
Figure 12:
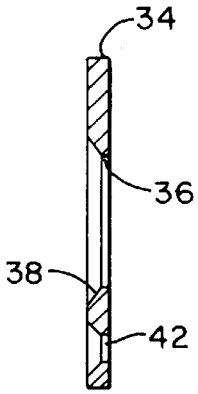
FIG. 12 is a cross-sectional view of the shoulder ring of FIG. 11 taken along the line 12—12 thereof.
Figure 13:
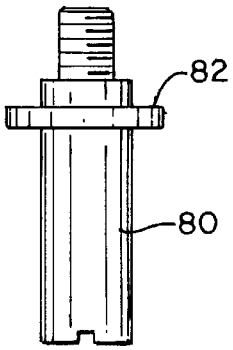
FIG. 13 is an enlarged side view of the guide pin of the self-adjusting armature assembly of FIG. 1.
Figure 14:
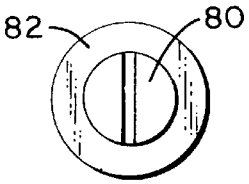
FIG. 14 is an enlarged top view of the guide pin of FIG. 13.

A mounting assembly 46 is positioned within the bore 32. The mounting assembly 46 has an expanded head portion 47 and a reduced shank portion 49. The mounting assembly 46 includes a first mounting collar 48 (FIGS. 7 and 8), a second mounting collar 50 (FIGS. 9 and 10) and a mounting bolt 52 which passes through the first and second mounting collars 48, 50. The second mounting collar 50 has an annular collar body 54 and a radially extending flange 56. The collar body 54 of the second mounting collar 50 has a lower portion 58 preferably beveled for contact with the first mounting collar 48. The lower portion 58 of the collar body 54 is dimensioned for reception in the opening 36 of the support ring 34. The flange 56 engages with the shoulder 44 to prevent the second mounting collar 50 from passing entirely through the opening 36 in the support ring 34.

The first mounting collar 48 is positioned between the second mounting collar 50 and the door vertical face 16. The first mounting collar 48 has a generally annular body 60 and a radially extending beveled flange 62. The beveled flange 62 defines an engagement bevel 63 oriented toward the armature plate 26. The engagement bevel 63 is generally equivalent to the annular bevel 38 of the support ring 34 to define generally mating frustoconical surfaces. The annular bevel 38 of the support ring 34 engages to the beveled flange 62 of the first mounting collar 48 to prevent the first mounting collar 48 from passing through the opening 36 of the support ring 34.

The mounting bolt 52 is a conventional bolt having an expanded head portion and a threaded shank. The first mounting collar 48 defines a bolt opening 64, and the second mounting collar 50 defines a bolt opening 66. The bolt openings 64, 66 are aligned for the passage of the shank portion of the mounting bolt 52 therethrough. The shank of the mounting bolt 52 extends beyond the first mounting collar 48 and is anchored to the door 12. The mounting bolt 52 preferably rotatably threadably engages a blind nut 68 extending through a bore 69 in the door 12. Alternately, the mounting bolt 52 can threadably engage the door 12 directly or be bolted or welded to a portion of the door structure.

Preferably, a single mounting assembly 46 and a single bore 32 and support ring 34 are located in the central portion of the armature plate 26 to allow small rocking motions of the armature plate 26. The small rocking motions of the armature plate 26 enhance the surface-to-surface engagement between the attractive face 24 of the armature plate 26 and the bonding face 22 of the electromagnet 18. Furthermore, a single mounting assembly 46 allows for a relatively efficient installation of the armature assembly 20.

Figure 6:
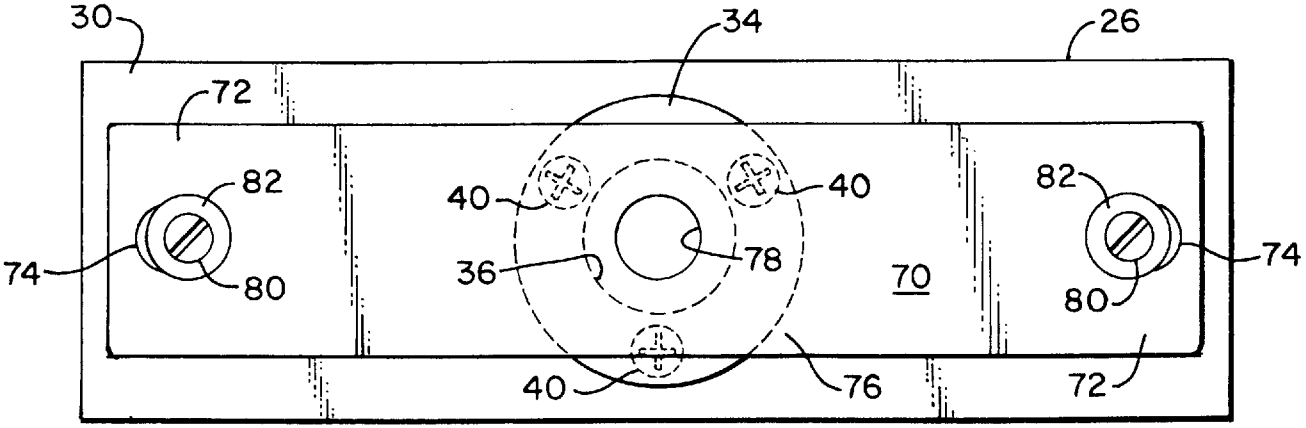
FIG. 6 is a rear view, partially in phantom, of the self-adjusting armature assembly of FIG. 5.

A flat spring 70 is interposed between the beveled flange 62 of the first mounting collar 48 and the door 12. The flat spring 70 has end portions 72 defining end openings 74. (See FIG. 6.) Positioned between the end portions 72 is an intermediate spring portion 76 having a central mounting opening 78. The central mounting opening 78 is dimensioned to allow passage of the body 60 of the first mounting collar 48 therethrough. The body 60 of the first mounting collar 48 preferably contacts the door vertical face 16. The beveled flange 62 has a diameter generally greater than the diameter of the central mounting opening 78 and therefore the flat spring 70 is captured between the beveled flange 62 and the door vertical face 16. The flat spring 70 in combination with the mounting assembly 46 and armature plate 26 results in a low profile armature assembly 20. Therefore, the armature assembly 20 is readily compatible with conventional electromagnetic locks and can be retrofitted to existing door security systems without significant additional expense.

Guide pins 80 extend through the end openings 74 in the spring 70 and are fixed to the rear face 30 of the armature plate 26. The guide pins 80 define an annular shoulder 82 having a diameter greater than the diameter of the end openings 74. The shoulders 82 limit to a minimal distance motion of the spring end portions 72 away from the armature plate 26. Therefore, the spring end portions 72 are generally fixed in a transverse direction relative to the armature plate 26. However, the spring end portions 72 are permitted to move longitudinally relative to the armature plate 26 to allow the flat spring 70 to flex. Alternate spring-retaining structures (not illustrated) that prevent transverse motion but do not limit the longitudinal motion of the end portions of the spring 70 are also possible. Alternatives include a strap which extends across the end portions 72 of the spring 70 and is fixed to the rear face 30 of the armature plate 26, or the end portions 72 of the spring 70 directly engaging the armature plate 26. The guide pins 80 preferably additionally extend through guide bores 84 in the door 12 to prevent rotation of the armature plate 26 around the mounting assembly 46.

In operation, the armature plate 26 of each armature assembly 20 is positioned in oppositely facing relationship to one of the electromagnets 18. In the un-energized, or unlocked state, the attractive face 24 of the armature plate 26 and the bonding face 22 of the electromagnet 18 of one of the electromagnetic locks 28 can be in surface-to-surface contact. (See right side of FIG. 1.) However, the attractive face 24 and bonding face 22 of the other electromagnetic lock 28 may or may not define an armature gap 23 therebetween. (See left side of FIG. 1.) For a given installation wherein the engagement characteristics may change over time, it is not known which, if any, of the electromagnetic locks will exhibit the gap 23. For either arrangement of the electromagnetic lock 28, the armature plate 26 is maintained in an initial position by the flat spring 70 wherein the beveled flange 62 of the first mounting collar 48 engages to the annular bevel 38 of the support ring 34. The shoulder 44 of the support ring 34 and the flange 56 of the second mounting collar 50 define an initial gap therebetween. (See FIG. 3.)

Figure 2:
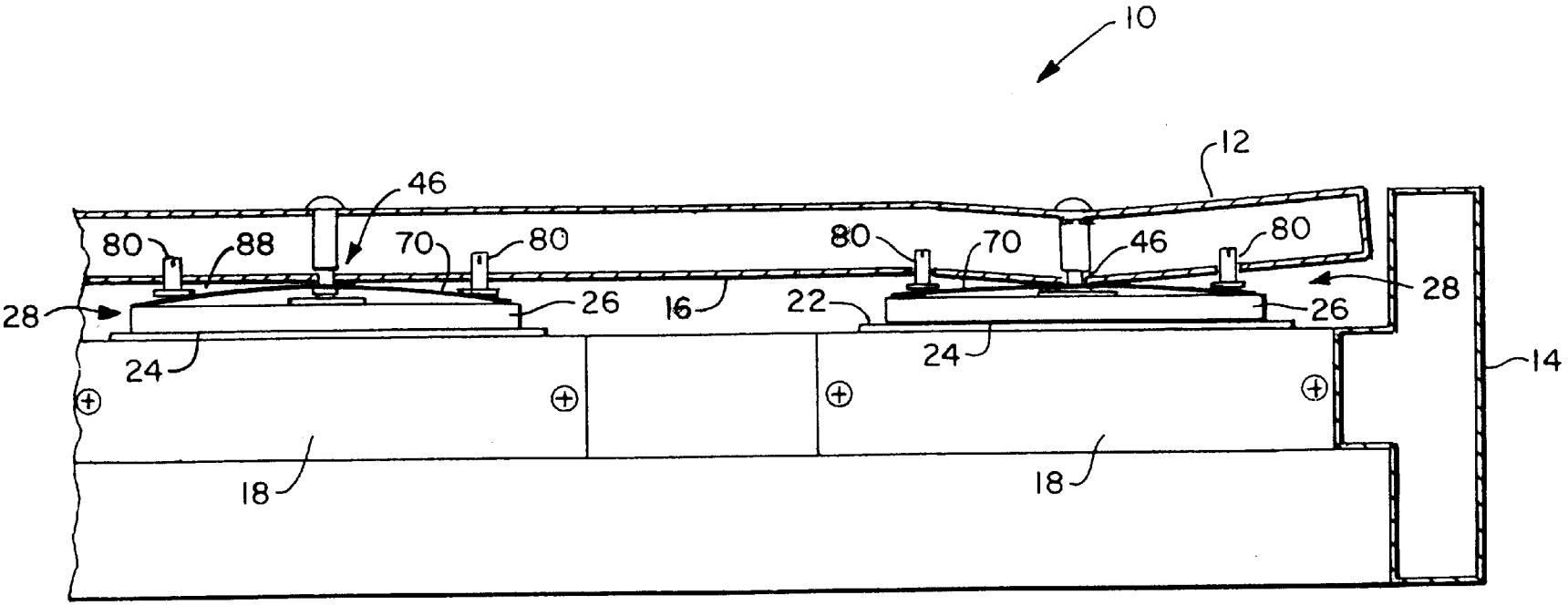
FIG. 2 is a fragmentary sectional view of the multiple electromagnetic lock system, door and door frame of FIG. 1 wherein the system is in an energized or locked state.

The electromagnet 18 attracts the armature plate 26 to place the bonding face 22 of the electromagnet 18 in surface-to-surface contact with the attractive face 24 of the armature plate 26 when the door security system 10 is locked. (See left side of FIG. 2.) The attractive force between the electromagnet 18 and the armature plate 26 overcomes the biasing force of the spring 70, and the armature plate 26 moves to an intermediate position wherein neither the bevel 38 of the support ring 34 is engaged to the beveled flange 62 of the first mounting collar 48, nor the shoulder 44 of the support ring 34 is engaged to the flange 56 of the second mounting collar 50. However, in some cases of severe misalignment or warpage of the door 12, the flange 56 of the second mounting collar 50 may engage the shoulder 44 of the support ring 34 in order to permit surface-to-surface contact between the electromagnet 18 and the armature assembly 20. Preferably, the armature assemblies 20 and the electromagnets 18 are positioned so that each armature assembly 20 maintains at least some gap between the shoulder 44 of the support ring 34 and the flange 56 of the second mounting collar 50. Therefore, the armature assembly 20 can continue to adjust for even greater armature gaps 23 if the door continues to distort.

When a force greater than the combined resilient force of the armature springs 70, such as a kick or battering, is applied to the door 12, both springs 70 flex. The door 12 and mounting assemblies 46 move until at least one of the flanges 56 of one of the armature assemblies engages the shoulder 44 of the support ring 34 of that same armature assembly 20. Should the force overcome the electromagnetic bonding force of that first armature assembly 26 to that first electromagnet 18, the door 12 will then move to where the flange 56 of the second mounting assembly 20 engages the shoulder 44 of the support ring 34 of the second armature assembly 20. Therefore, even though the bonding engagement of one of the electromagnetic locks 28 has been overcome, the second electromagnetic lock 28 maintains the door 12 in a secured state.

When the armature plate 26 moves from the initial position to an intermediate position, the intermediate portion 76 of the spring 70 is maintained in a fixed position relative to the door 12 by the beveled flange 62 of the first mounting collar 48. The end portions 72 of the spring 70 engage against the shoulders 82 of the guide pins 80 to flex the flat spring 70 and create a spring gap 88 between the door 12 and the flat spring 70. On removal of the force against the door 12, the flat spring 70 acts against the shoulders 82 of the guide pins 80 to move the armature plate 26 transversely and reestablish the initial gap 86.

While a preferred embodiment of the invention has been shown and described, various modifications and substitutions may be made thereto without departing from the spirit and scope of the invention. Accordingly, it is to be understood that the present invention has been described by way of illustration and not limitation.

I claim:

1. A multiple electromagnetic lock system comprising:

a barrier frame defining a barrier opening;

a barrier mounted to said barrier frame for selectively closing across said barrier opening, said barrier defining a barrier face; and a plurality of electromagnetic lock assemblies for locking said barrier to said barrier frame, each lock assembly comprising:

an electromagnet mounted to said barrier frame, and an armature assembly mounted to said barrier face for electromagnetic bonding to said electromagnet when said barrier is closed, said armature assembly comprising an armature plate having an attractive face oriented toward said electromagnet and an oppositely positioned rear face oriented toward said barrier face, said armature plate defining a stepped opening through said rear face, a reducer ring mounted to said rear face, said reducer ring defining a shoulder, and mounting means for mounting said armature plate to said barrier face, said mounting means comprising a support collar defining a support collar bevel oriented towards said reducer ring and positioned between said armature plate and said barrier, said reducer ring defining a reducer ring bevel generally congruent with said support collar bevel and oriented toward said barrier, wherein said armature plate has a first position closer to said barrier face and a second position away from said barrier face, said reducer ring bevel and said support collar bevel being disposed in swiveling engagement when said plate is in said first position and spring means for biasing said armature plate to said first position.

2. The multiple electromagnetic lock system of claim 1 wherein each said armature plate defines a stepped opening through said rear face to define a shoulder in said armature plate and each said mounting means has a mounting assembly comprising an enlarged head portion positioned in said stepped opening, and a reduced shank portion extending from said stepped opening and mounted to said barrier, said head portion and said shoulder in engagement when said armature plate is in said second position, and said head portion and said shoulder together defining a gap therebetween when said armature plate is in said first position.

3. The multiple electromagnetic lock system of claim 2 wherein said spring means comprises a flat spring.

4. The multiple electromagnetic lock system of claim 1 wherein said reducer ring bevel is circular and defines a concave recess, and said support collar bevel is circular and defines a convex projection.

5. The multiple electromagnetic lock system of claim 1 further comprising a plurality of guide pins extending from said rear face of said armature plate, and said barrier defining a plurality of guide pin openings through said barrier face, said locating posts extending into, said guide pin openings.

6. An armature assembly for an electromagnetic lock comprising:

an armature plate having an attractive face and an opposite rear face, and defining a continuous armature opening having a diameter and extending through said rear face;

a reducer mounted to said rear face and across said opening, said reducer defining a reduced opening having a diameter smaller than said diameter of said armature opening, said reducer defining a bevel which is circular and defines a concave recess;

mounting means for mounting said armature to a barrier face, said mounting means comprising a mounting assembly having an expanded head portion defining a diameter greater than said reducer diameter and positioned in said armature opening, and a shank portion mountable to a barrier face extending through said reducer opening, a collar mounted over said shank positioned outside of said armature opening, said collar having a diameter greater than said reducer diameter, said collar defining a bevel congruent with said reducer bevel and disposable in swiveling engagement therewith, said collar defining a convex projection, and said armature plate having a first position on said mounting means wherein said collar and said reducer are engaged and said head portion and reducer define a gap therebetween, and a second position wherein said head portion and said reducer are engaged and said collar and said reducer define a gap therebetween; and spring means for biasing said armature plate to said first position.

7. The armature assembly of claim 6 further comprising a plurality of guide pins extending from said rear face of said armature plate extendable into openings in a barrier.

8. The armature assembly of claim 6 wherein said spring means comprises a flat spring.

9. The armature assembly of claim 8 wherein said flat spring defines a spring opening and said shank passes through said spring opening.

10. The armature assembly of claim 6 wherein said mounting assembly comprises a bolt having a bolt head and a bolt shank for mounting to a barrier, and a second collar surrounding said bolt head and engageable to said reducer.

11. The armature assembly of claim 9 further comprising a plurality of guide pins extending from said rear face of said armature plate, said spring defining opposite end portions, each of said end portions engaged to one of said guide pins.

12. A barrier assembly for engagement to an electromagnetic lock system comprising:

a barrier defining a barrier face; and a plurality of adjacent armature assemblies mounted to said barrier face for engagement with an associated electromagnet, each said armature comprising:

an elongated armature plate having an attractive face, an opposite rear face, and defining a longitudinal axis, said attractive faces of said armature plates being generally coplanar and said axes are generally linearly aligned, said armature plate defining a stepped opening through said rear face to define a shoulder in said armature plate, mounting means for mounting said armature plate to said barrier wherein said armature plate has a first position closer to said barrier face and a second position away from said barrier face, each said mounting means having a mounting assembly comprising a large head portion in said stepped opening, and a reduced shank portion extending from said stepped opening and mounted to said barrier, said head portion and said shoulder in engagement with said armature in said second position, and said head portion and shoulder defining a gap therebetween when said armature is in said first position, a support collar being positioned between said armature plate and said barrier for allowing swiveling engagement between said armature plate and said support collar when said armature plate is in said first position, and biasing means comprising a flat spring for biasing said armature plate to said first position.

13. The barrier assembly of claim 12 wherein the barrier has an upper portion terminating in a barrier top edge and a lower portion, said armature assemblies mounted to said upper portion and said axes of said armature plates generally parallel to said top edge.

* * * * *